United States Patent [19]

Bender et al.

[11] Patent Number: 4,553,749

[45] Date of Patent: Nov. 19, 1985

[54] TOY AND GAME APPARATUS

[76] Inventors: Robert L. Bender; Annie L. Bender, both of 513 W. Ferry St., Berrien Springs, Mich. 49103

[21] Appl. No.: 542,159

[22] Filed: Oct. 14, 1983

[51] Int. Cl.[4] ..... A63F 7/02; A63H 18/02

[52] U.S. Cl. ..... 273/1 R; 273/86 C; 446/168

[58] Field of Search ..... 273/1 G, 1 GA, 1 GB, 273/86 C, 120, 1 R; 446/168, 169, 171–174, 85, 89; 193/2 R

[56] References Cited

U.S. PATENT DOCUMENTS

| | | | |
|---|---|---|---|
| 124,078 | 2/1872 | Ostrander . | |
| D. 214,302 | 6/1969 | Barger . | |
| D. 223,463 | 4/1972 | Daenen . | |
| 257,630 | 5/1882 | Whitney | 446/85 X |
| 693,826 | 2/1902 | Bottger . | |
| 1,216,840 | 2/1920 | Ramsey et al. . | |
| 1,621,178 | 3/1927 | Strub . | |
| 1,894,605 | 1/1933 | Wright . | |
| 2,000,808 | 5/1935 | Williams . | |
| 3,069,805 | 12/1962 | Burrows . | |
| 3,145,501 | 8/1964 | Grosser . | |
| 3,464,699 | 9/1969 | Dollar . | |
| 3,610,628 | 10/1971 | Promin . | |
| 3,822,569 | 7/1974 | Lautrup-Larsen . | |
| 3,946,516 | 3/1976 | Wirth . | |

FOREIGN PATENT DOCUMENTS

| | | | |
|---|---|---|---|
| 445703 | 6/1927 | Fed. Rep. of Germany | 446/168 |
| 1057512 | 5/1959 | Fed. Rep. of Germany | 446/85 |
| 2547070 | 4/1977 | Fed. Rep. of Germany | 446/168 |

OTHER PUBLICATIONS

Kusan Inc. Catalog, p. 15, ©1970, Max Trax No. 500.

*Primary Examiner*—Paul E. Shapiro
*Attorney, Agent, or Firm*—Barnes & Thornburg

[57] ABSTRACT

A toy block is provided having an integrally formed, recessed surface disposed in a portion thereof which defines an open inclined passageway between sides of the block element. Game apparatus may be formed from a plurality of such block elements. The individual block elements may be arranged in various adjacent and spaced apart vertical and horizontal orientations by the players in turn during the initial course of play. After a predetermined number of such block elements have been so arranged, the players may again in turn reorient block elements in attempts to define the longest possible extended path formed by the surfaces and passageways of such block elements and the vertical spaces therebetween.

8 Claims, 4 Drawing Figures

TOY AND GAME APPARATUS

BACKGROUND OF THE INVENTION

The present invention relates generally to toys and games for amusement and education and, more particularly, to such games having a plurality of individual block elements which may be arranged cooperatively into various orientations.

Previously known toys include geometric solids or frame and hollow members suitable for use as block elements which may be arranged into adjacent, stacked, or spaced orientations. Such toys often include inclined surfaces or passageways therein over or through which a movable object, such as a small ball or marble, may freely roll. However, mere inclined surfaces do not usually provide adequate guidance to assure that the marble will travel along a predeterminable path. Blocks having passageways or U-channels therethrough may provide this guidance but are not typically inclined sufficiently to permit significant gravitational impetus to provide marble motion without the use of additional elevating means. Further, prior toy blocks having U-channels therein often do not permit that channel to extend completely through the block from side to side, thus limiting the travel of the marble.

If a plurality of such toy blocks are to be arranged together so as to form an extended path for marble motion from block to block in a game apparatus, prior devices have often employed closed conduits, complicated block interconnections, and non-integral vertical elevation assemblies. Closed conduits, whether integrally formed with the block or assembled therein, are relatively expensive to fabricate and may become clogged, especially when used improperly by small children. Likewise, block interconnections and elevation assemblies are expensive to fabricate, restrict use by younger children, and limit the variety of orientations available for such blocks.

Game apparatus are also known wherein a plurality of toy blocks containing passageways may be strategically reoriented during the course of play such that the path length of marble travel changes. However, such apparatus typically restrict block reorientation to a single horizontal or vertical plane and permit ball motion only between adjacent block passageways on the same plane of ball motion.

Thus, the need has arisen for a toy block and game apparatus which retains the advantages of prior art devices and overcomes their deficiencies and limitations to permit a variety of new and improved uses.

OBJECTS AND SUMMARY OF THE INVENTION

An object of the present invention is the provision of a novel toy device for entertainment and education.

Another object of the present invention is to provide an inexpensive toy device that may be employed individually or with a plurality of similar toy devices in a game apparatus.

A further object is the provision of a game apparatus and method of playing the same for use by a plurality of players which requires strategic insight to comprehend fully the ramifications of movement in the course of play.

These and other objects of the present invention are attained in the provision of a toy block element. A freely movable ball or marble means may be employed to roll along those extended paths to define their lengths. Random number generating means, such as dice, may be employed to determine player turn and/or the number of different block elements which may be arranged in a given player's turn. A considerable amount of strategic skill and foresight will be necessary during initial arrangement of the block elements to enable a particular player to establish the longest extended path during his turn and prevent other players from doing so previously.

Other objects, advantages, and novel features of the present invention will become apparent to those skilled in the art when the following description of the preferred embodiments is considered in conjunction with the drawings.

DESCRIPTION OF THE PREFERRED EMBODIMENTS

Figure 1:
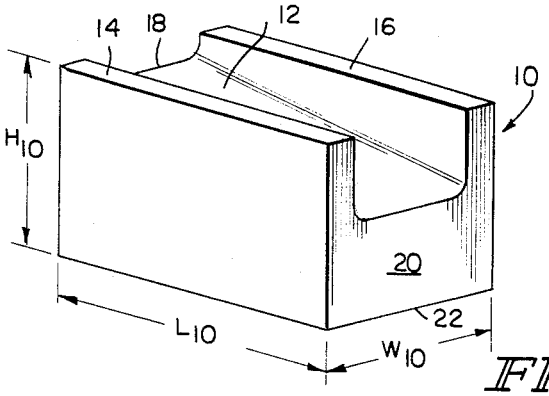
FIG. 1 is a perspective view of an individual toy block element according to the principles of the present invention.

FIG. 1, which illustrates a preferred embodiment of a toy block element according to the present invention, shows a toy block element 10, formed from any convenient material, such as wood or plastic. Block element 10 is shown as being a geometric solid of a generally rectilinear shape having a height $H_{10}$, width $W_{10}$, and length $L_{10}$. The present invention specifically contemplates, however, that various other shapes and configurations may be employed, including non-solid or framed and hollow structures.

Block element 10 includes recessed surface 12, which may be formed integrally with block element 10 between top side edges 14 and 16. Surface 12 provides an inclined and recessed passageway through block element 10 between end sides 18 and 20. Although not essential to the subject invention, it has been found to be particularly advantageous to provide surface 12 with a continuous downward slope over its entire length such that surface 12 meets end sides 18 and 20 at different elevations from base side 22. Surface 12 may be formed such that the passageway between end sides 18 and 20 forms a smooth U-channel of constant width. An alternative embodiment of the present invention, not shown in the figures, would provide for surface 12 to define a passageway between the top side (in a plane between top side edges 14 and 16) and end side 20 or to end the passageway before reaching one of the end sides. Further modifications could provide for more than one such passageway in block element 10. In general, an open chute or U-channel passageway will better resist clogging and is relatively easy to fabricate.

Figure 2:
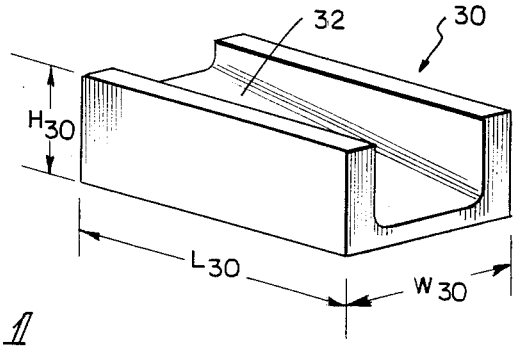
FIG. 2 is a perspective view of another embodiment of an individual toy block element according to the principles of the present invention.
Figure 3:
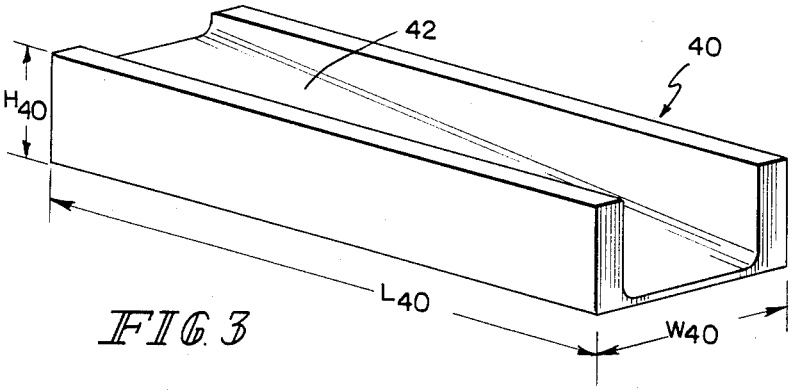
FIG. 3 is a perspective view of still another embodiment of an individual toy block element according to the principles of the present invention.

FIGS. 2 and 3 show additional toy block elements 30 and 40, respectively, according to the present invention which may be employed individually or in conjunction with block element 10 and/or a number of other block elements according to the present invention in a game apparatus. Block elements 30 and 40 may, for example, resemble block element 10 in general configuration. Block element 30 has height $H_{30}$, width $W_{30}$, and length $L_{30}$. Block element 40 has height $H_{40}$, width $W_{40}$, and length $L_{40}$. $L_{30}$ and $W_{30}$ may, for example, be equal in size to $L_{10}$ and $W_{10}$, respectively, while $H_{30}$ is only one-half the size of $H_{10}$. Likewise, $W_{40}$ and $H_{40}$ may be equal to $W_{10}$ and $H_{30}$, respectively, while $L_{40}$ is twice the size of $L_{10}$. Thus, block elements 10 and 30 may be arranged end to end to have a length equal to that of block element 40, and block elements 30 and 40 may be stacked top to base to have a height equal to that of block element 10. The actual dimensions of such block elements may be of any convenient size and need not, in every embodiment, share a particular relationship to the dimensions of other block elements constructed according to this invention, even if employed in the same game apparatus.

Block elements 30 and 40 also have recessed surfaces 32 and 42 formed integrally therewith, respectively. It has been found to be advantageous at least to mass fabrication of such block elements, to form surfaces 12, 32, and 42 such that they have a common angle of inclination or slope. Further, if a continuous passageway between blocks 10 and 30 is desired, the elevation above the base side of the upper end of surface 32 should be equal to or just less than the elevation above the base side of the lower end of surface 12 (meeting end side 20).

Block elements 10, 30, and 40 may be employed as individual block toys in a variety of different ways, depending upon the creativity and imagination of the user. Since surfaces 12, 32 and 42 may form a smooth downwardly inclined chute, these block elements may also be suitable for translating gravitational attraction of a freely movable object into extended transverse motion of that object. As a simple example, a conventional spherical ball or marble, having a diameter less than the distance across surface 12 between top side edges 14 and 16, may be positioned at the upper end of surface 12 and permitted to roll along its length to and beyond the lower end of surface 12.

A plurality of such block elements may be employed cooperatively in a variety of game apparatus for competitive activity between several players. For example, a predetermined number of block elements according to the present invention may be initially arranged and then reoriented during the course of play by various players in an attempt to create the longest path through the recessed and inclined passageways of several of the block elements and along which a marble will roll. In such a same apparatus it may be especially advantageous to employ block elements of various dimensional sizes so as to permit a variety of stacked and spaced apart orientations of the block arrangment. Further, in order to reduce fabrication costs and permit extensive development of arrangement strategies by individual players, the various dimensional sizes of the block elements may be of unit size (such as $W_{10}$ with respect to block elements 10, 30 and 40, $H_{30}$ with respect to block elements 30 and 40, and $L_{10}$ with respect to block elements 10 and 30) or of integer multiples of that unit size (such as $H_{10}$ and $L_{40}$).

A method of employing such a competitive game apparatus may include a random number generator means of any convenient type, such as dice (shown in FIG. 4) or a spinner, to determine the order of player turns. Each player in turn takes a number of these block elements and arranges them in spaced apart or adjacent or vertically stacked relation on a convenient playing surface according to whatever strategic considerations he may have in mind. The number of block elements to be arranged by a particular player at a particular time may also be determined by the random number generating means. For example, if at the start of his turn a player rolls a "three" on the dice, he may position three block elements on a table. These three block elements do not necessarily have to be in contact with each other or any previously positioned block elements, nor do they have to provide a continuous chute for marble motion at these initial turns. The sides containing recessed surfaces 12, 32, or 42 may likewise be positioned in any desired orientation. This course of play, alternatingly arranging block elements, may continue until all of the block elements are so arranged. Then, each player in turn, starting with the last player to initially position block elements, may attempt to roll a marble under gravitational impetus, down the longest available path created by the inclined passageways and/or the block surfaces in that particular orientation of block elements. The marble run does not necessarily have to begin at the highest block element, nor does it have to end at the playing surface. The next player in turn may reorient a predetermined number of block elements within that existing arrangement in an effort to define a longer path for his marble run than the previously longest path. If he is able to achieve a longer marble run, i.e., define a longer path and roll the marble along that path, those reoriented block elements may remain in their new position. If he is unsuccesful either defining a longer path or rolling the marble along that path, those block elements which he reoriented are returned to their previous position in the block element arrangement. The game is won by the last player who is able to lengthen the path in a manner to make the longest possible successful marble run.

Figure 4:
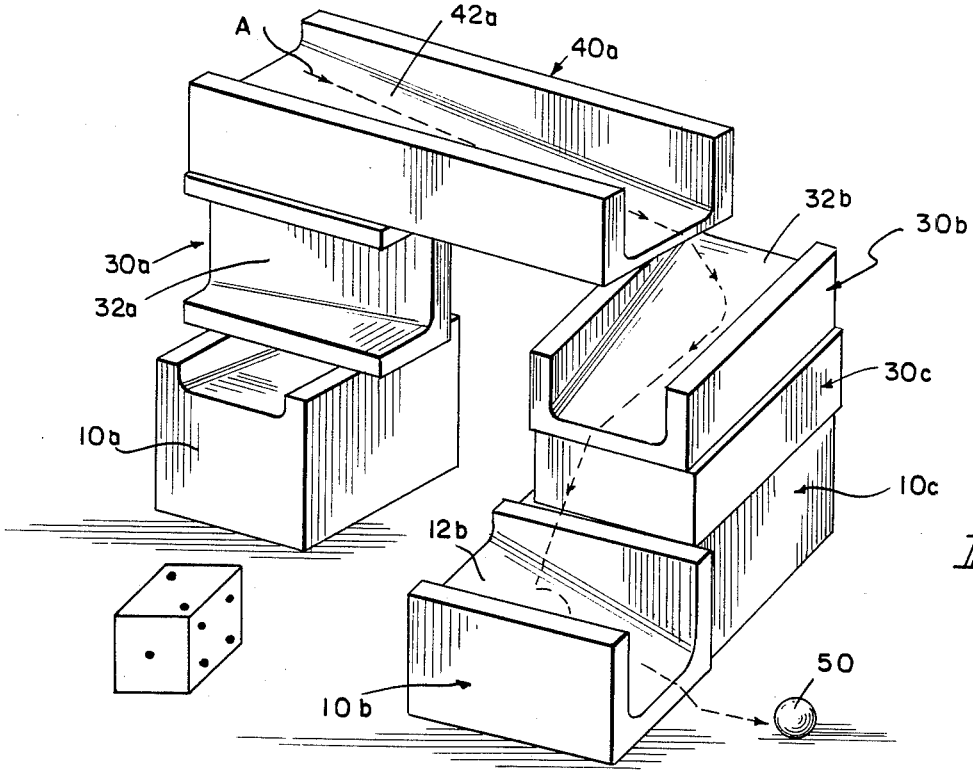
FIG. 4 is a perspective view of a possible arrangement of the toy block elements shown in FIGS. 1–3 as employed in a game apparatus according to the principles of the present invention.

FIG. 4 illustrates one possible arrangement of plural block elements during the course of play of such a game apparatus. Block element **30*a*, having sideways positioned surface 32*a*, is stacked on top of block element 10*a*. Block element 40*a*, having upwardly positioned surface 42*a*, is then stacked on top of block element 30*a*. Block elements 10*b* and 10*c* are side by side and spaced apart from block element 10*a*. Surface 12*b* is upwardly positioned. Block element 30*b* is stacked on top of block element 30*c*, which is on top of block element 10*c*. Surface 32*b* is upwardly positioned and vertically below and adjacent to the lower end of surface 42*a*. The lower end of surface 32*b* is spaced directly above surface 12*b*. A player may begin a marble run by placing marble 50 at point A on block element 40*a*. The marble may freely roll down along the channel created by recessed surface 42*a* and drop into the channel created by surface 32*b*. Continuing to roll along this second channel, marble 50 may drop into the channel created by surface 12*b*** and from there onto the playing surface at point B. The path of marble travel from A to B defines the length of the extended path.

While the above mentioned method of employing such a game apparatus includes rules of play which are relatively simple and easily understood by a novice, it will be readily apparent that mastery of the game will involve considerable skill and strategy. Each block element must be considered for positioning in a multitude of different orientations and in combination with other block elements of various sizes and orientations. Considerable insight is necessary to fully understand the ramifications of a particular block element arrangement, especially during the initial turns. Initial location of block elements may be crucial in developing game strategies.

Although the present invention has been described above in detail, the same is by way of illustration and example only and is not to be taken as a limitation upon the spirit and scope of the present invention, as defined only by the terms of appended claims.

What is claimed is:

1. A game apparatus comprising:

a plurality of block elements having integral surface means therein for providing at least one recessed, inclined passageway extending between sides of the individual block elements, wherein said block elements may be arranged during the course of play such that various paths may be defined along a plurality of said inclined passageways;

random number generating means for determining the number of said block elements which may be arranged at a particular time during the course of play; and freely movable means for traveling along said paths defined by said passageways.

2. The game apparatus according to claim 1 wherein said block elements may be arranged adjacently and spaced apart during the initial course of play into various vertical and horizontal orientations until a predetermined number of said block elements are so employed, and wherein said block element orientations may be manipulated during the later course of play so as to alter the length of said paths.

3. The game apparatus according to claim 1 wherein said freely movable means includes a generally spherical ball.

4. The game apparatus according to claim 1 wherein said block elements may be stacked to vertically elevate said passageways.

5. A method of employing a game apparatus having a predetermined number of block elements with integral recessed surface means therein for providing passageway means extending to at least one side of said block elements, comprising:

arranging said block elements in vertically and horizontally adjacent and spaced apart orientations until all of said block elements are so employed; and reorienting said block elements so as to align a plurality of said passageway means and block element surfaces to define at least one extended path.

6. The method according to claim 5 wherein said game apparatus further includes random number generating means and said method further includes alternation between players of said arranging of said block elements wherein said random number generating means defines the number of said block elements so arranged during each player turn.

7. The method according to claim 5 wherein said reorienting of said block elements includes individually repositioning said block elements such that if said alignment of said passageway means and said block element surfaces results in the definition of a longer extended path, the reoriented block element remains in that new orientation and if not, said reoriented block element is returned to its previous orientation.

8. The method according to claim 5 wherein said game apparatus further includes a freely movable means for traveling along said passageway means and said block element surfaces, and wherein said method further includes applying said freely movable means to said extended path to define a length of travel along said path.

* * * * *